United States Patent [19]

North et al.

[11] Patent Number: 4,511,092

[45] Date of Patent: Apr. 16, 1985

[54] MILLING APPARATUS

[76] Inventors: Henry North, R.R. #16, Thunder Bay, Ontario, Canada, P7B 6B3; William R. Fauconnier, 1759 Meryle St., Thunder Bay, Ontario, Canada, P0T 2Z0

[21] Appl. No.: 489,043

[22] Filed: Apr. 27, 1983

[51] Int. Cl.[3] ..... B02C 19/16

[52] U.S. Cl. ..... 241/49; 241/153; 241/171; 241/172; 366/131

[58] Field of Search ..... 241/46.02, 46.11, 46.17, 241/49, 153, 171, 172, 72, 71, 175, 284, 199.11; 366/131; 414/199, 200, 201; 222/365

[56] References Cited

U.S. PATENT DOCUMENTS

| | | | |
|---|---|---|---|
| 926,441 | 6/1909 | Shafter | 241/172 |
| 1,859,499 | 5/1932 | Deschamps | 241/49 X |
| 2,042,254 | 5/1936 | Godinez | 241/172 X |
| 2,391,110 | 12/1945 | Walker | 366/131 |
| 3,937,406 | 2/1976 | Klimaschka | 241/172 X |
| 4,044,957 | 8/1977 | Schold | 241/46.11 |
| 4,117,981 | 10/1978 | Engels | 241/172 X |

FOREIGN PATENT DOCUMENTS

| | | | |
|---|---|---|---|
| 393223 | 6/1933 | United Kingdom | 222/365 |
| 1314789 | 4/1973 | United Kingdom | 241/46.11 |
| 130331 | 3/1960 | U.S.S.R. | 241/172 |

*Primary Examiner*—Mark Rosenbaum
*Assistant Examiner*—Joseph M. Gorski
*Attorney, Agent, or Firm*—Stanley G. Ade

[57] ABSTRACT

A milling apparatus comprises a container with a plate extending across the container and movable relative thereto by an oscillator which communicates oscillatory movement to the plate at right angles to its plane. The oscillation can be tuned so that the natural frequency of oscillation of the plate and communication means is the same as or a whole number multiple of the oscillation frequency of the oscillator. The oscillator comprises a rotatable eccentric member driven to provide mechanical oscillations. The plate within the container acts to agitate grinding elements provided within the container. The container can either be used in a batch mode by moving the plate from an inlet to an outlet or in a continuous flow mode in which the comminuted material passes the plate from an inlet to an outlet.

9 Claims, 2 Drawing Figures

MILLING APPARATUS

BACKGROUND OF THE INVENTION

The invention relates to apparatus for grinding particulate material and particularly of the type wherein grinding elements, generally balls, are agitated within a container to grind the material.

One example of a grinding apparatus is disclosed in Candian Pat. No. 1,108,574 of North comprising an agitated container including a plurality of balls or other grinding elements. However this apparatus is slow and cumbersome to operate in view of the difficulty of loading and unloading the material.

SUMMARY OF THE INVENTION it is one object of the invention to provide an apparatus of this type in which the balls or grinding elements are agitated by oscillation and which is of a simple structure which is easy to operate.

According to the invention therefore there is provided an apparatus for milling particulate material comprising a container for receiving the material, a plate mounted within the container for movement relative thereto, a plurality of grinding elements within the container on at least one side of the plate, an oscillator, and means for communicating oscillation from said oscillator to the plate to oscillate the plate relative to the container in a direction generally at right angles to the plane of the plate to agitate the grinding elements.

It is one advantage of the invention that the plate may be moved from a loading position adjacent an inlet in the container at which the material to be ground may be loaded to a working position and to an unloading position adjacent an outlet at which the ground material is removed.

It is another advantage of the invention that the plate may be of smaller size than the container such that the ground material can pass from one side to the other without the passage of balls whereby the material can continually pass from an inlet at one side to an outlet at the other to provide continuous operation of the device.

It is a further advantage of the invention that the ground material can be conveyed from the container in a gas stream passing from a gas inlet to the outlet.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
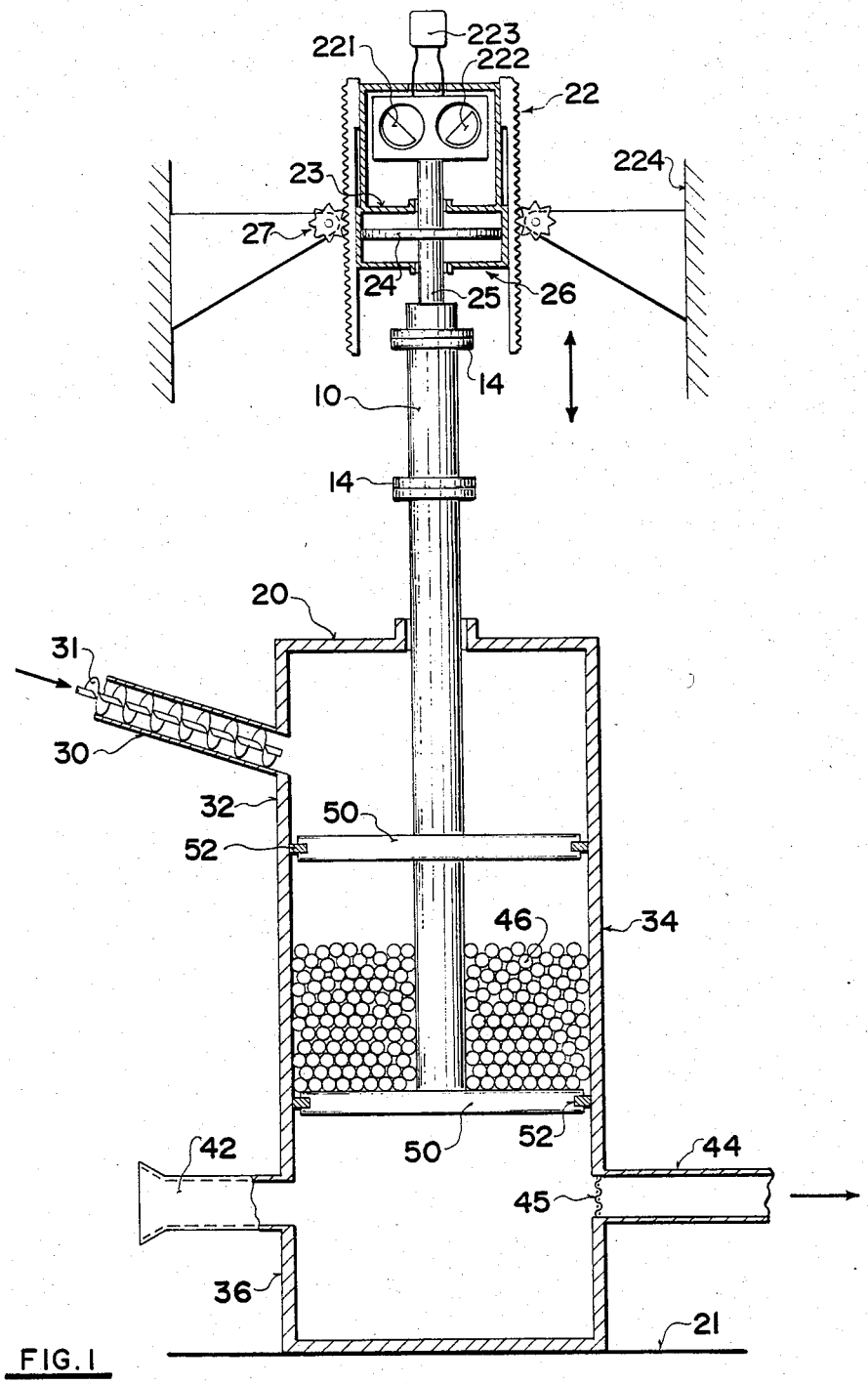
FIG. 1 is a schematic cross sectional view of a first embodiment of milling apparatus according to the invention.

Referring firstly to FIG. 1, the milling apparatus comprises a ball mill 20, a variable frequency oscillator 22 and an elongate oscillator condenser 10.

The oscillator 22 comprises a mechanical oscillator which is commercially available, for example, from Hawker, Sidderley Limited and comprises a pair of rotary bodies 221, 222 carried in chambers in the main body of the oscillator together with a hydraulic or electric motor schematically indicated at 223 for driving the rotation of the bodies 221 and 222. The rate of rotation of the bodies can be varied by adjusting the motor speed so as to increase or decrease the frequency of vibration.

The oscillator 22 incorporates a cylinder 23 within which a piston 24 slides on an output shaft 25 of the oscillator. The piston and cylinder 23, 24 provide an air spring 26 so as to limit the amplitude of the vibration transmitted to the foundation support 224 on which the oscillator assembly 22 is mounted in a rack and pinion adjustment device 27. The shaft 25 is connected to the oscillator condenser 10 which comprises a steel pipe extending linearly from the output shaft 25 to plates 50 of the ball mill 20. The piston and cylinder 23, 24 together with an opening in the ball mill 20 provide bearings which allow small amplitude sliding movement of the pipe 10 so that the oscillation can be communicated from the output shaft 25 to the plates 50.

The apparatus is tuned so that the frequency of oscillation of oscillator 22 is the same as or substantially the same as the natural frequency of vibration of the pipe 10. This ensures that the maximum power is communicated from the oscillator to the plates 50 without substantial losses. It is also acceptable for the tuning that one of the oscillator frequency and the natural vibration frequency is a whole number multiple of the other.

The tuning is achieved firstly by suitable selection of the pipe 10. Such criteria for selection will include the diameter of the pipe, the thickness of the pipe, the material of the pipe and the length of the pipe. The tuning is independent of the cross sectional shape of the pipe so that shapes other than circular cross-section can be used without departing from the invention. The material itself has an effect on the modulus of elasticity of the pipe which affects the natural vibration frequency. Using a pipe of a particular diameter, thickness and material, tuning is then achieved by varying the length of the pipe. For this purpose, the pipe is comprised of a number of separate sections, each of which carried a flange 14 on each end so that the sections can be clamped together by suitable bolts. In order to increase the length of the pipe therefore a further section can be added by separating two of the sections and inserting a further section. Similarly, the length can be decreased by removing one of the sections. Such a method of tuning the apparatus is relatively crude, but in practice it has been found to be satisfactory.

Alternatively, or in addition, tuning can be achieved by using a ring condenser or a beam condenser as disclosed in our copending patent application Ser. No. 447,009.

The ball mill 20 comprises a container 20 which is affixedly supported upon the ground indicated at 21 so as to remain stationary relative to the oscillator 22. The container 20 is effectively divided into three sections indicated at 32, 34 and 36, each of which is roughly a third of the height of the container 20. In the upper section 32 is provided an inlet 30 including a screw conveyor 31 by which material can be fed into the container 20. The lower section 36 includes an outlet 44 and a gas inlet 42.

The plates 50 are fixedly secured to the oscillator condenser 10 at right angles thereto and have a periphery which is substantially co-extensive with the interior surface of the container 20 which is preferably of cylindrical shape whereby the plates 50 are circular in plan view. Each of the plates 50 carries around its peripheral edge, a seal 52 which cooperates with the interior wall of the container 20 to prevent material passing from one side of the plate to the other side. The plates 50 are thus free to oscillate vertically within the chamber 20. In addition, the whole assembly comprising the oscillator 22, air spring 26, condenser 10 and plates 50 can be raised or lowered relative to the chamber 20 by means schematically indicated at 27 comprising a rack and pinion system provided on the air spring 26.

More specifically, the assembly can be raised to a position in which the plates 50 lie wholly within the section 32 of the chamber 20 so that the inlet 30 communicates with the space between the plates 50. In this position material to be milled can be added to grinding elements already positioned between the plates 50 and maintained between the plates 50 by the seals 52. Thus, in the first upper position adjacent the section 32, the material is loaded into the position between the plates 50 to substantially fill the space together with the grinding elements 46.

When filled, the assembly is lowered to the central position 34 as shown in FIG. 1. In this position, the oscillator 22 imparts longitudinal oscillations to the condenser 10 which in turn oscillates the plates 50 with shock waves of sine wave shape. Mechanical oscillators of 148, 248 and 1,000 h.p. are commercially available with a frequency limit of 150 Hz. The particulate material to be ground is subjected to a force lying in the range 30,000 to 225,000 lbs. at 130 Hz with a displacement amplitude of about 0.2 inches. The grinding elements 46 which comprise steel balls are thus energized and the material particles are deformed therebetween reducing their size to less than 37 microns.

The plates 50 can be rotated relative to the container 20 about the axis of the condenser 10 by means (not shown).

After a predetermined time of milling, the device 27 is operated to lower the plates into the portion 36 of the chamber 20 so that the material and grinding elements lie adjacent the gas inlet and material outlet 42, 44. The outlet 44 includes a filter screen 45 such that the gas stream which can either be air or an inert gas, passes through the material and grinding elements and carries out the particulate material through the outlet 44. The grinding elements remain within the confines defined by the container 20 and the plates 50 for loading of a further batch of material in the portion 32 of the container 20.

The milling apparatus therefore operates on batches of the material to be milled or comminuted. Substantially continuous production can be obtained by using two of the apparatus shown in FIG. 1 in tandem. A cooling jacket can be provided around the container 20 if desired to maintain the temperature of operation at a desired level.

The invention can be used for the comminution of coal or similar materials and is also suitable for organic and inorganic chemical reactions involving fluids and solids. As the resonant sonic comminutor of the present invention will operate at 0 gravity or independently or gravitational field strength, it can be used in outer space laboratory applications and outer space production facilities.

Figure 2:
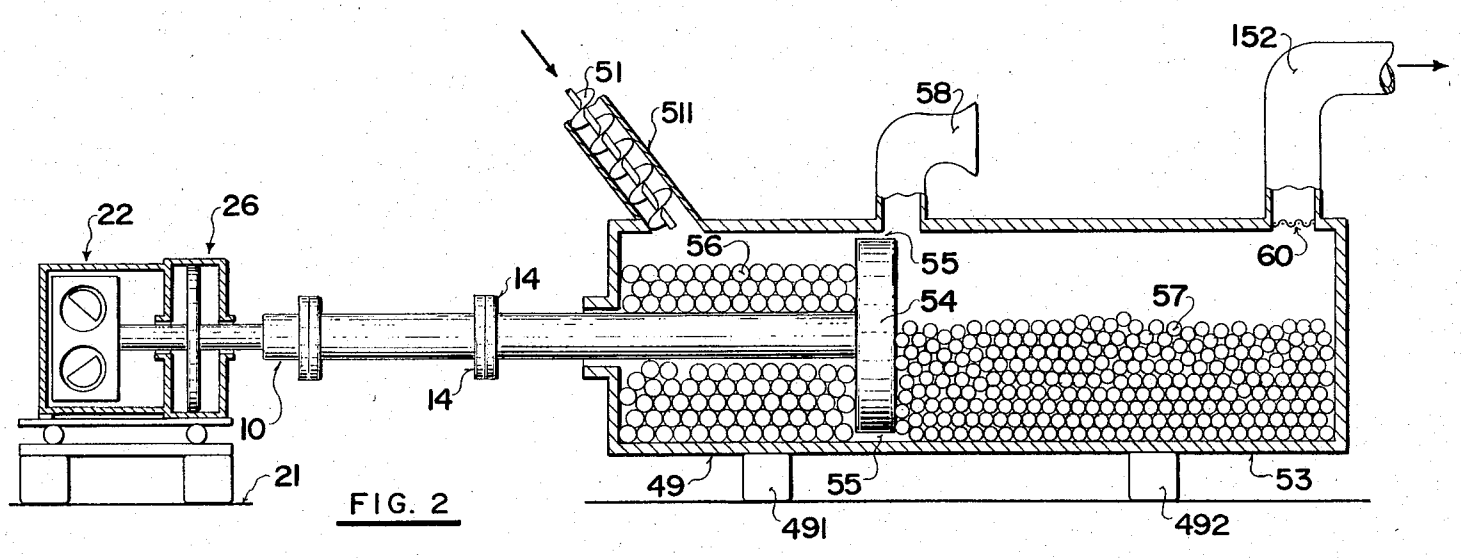
FIG. 2 is a view similar to that of FIG. 2 of a second embodiment according to the invention.

Turning now to FIG. 2, the embodiment shown employs the same oscillator, air spring and condenser as that shown in FIG. 1 except that the apparatus is arranged in horizontal orientation as opposed to the vertical orientation of FIG. 1. However, the ball mill 20 of FIG. 1 is replaced by a ball mill 49 in FIG. 2 including an inlet 51, an outlet 152, a container 53 and a plate 54. The plate 54 is substantially co-extensive with the interior surface of the container 53 except that a small gap 55 is provided around the periphery of the plate 54 to allow the passage of comminuted material from one side of the plate to the other through the gap 55, but to prevent the passage of grinding elements indicated at 56, 57. It will be noted that the inlet 51 is provided on one side of the plate 54 and the outlet 152 on the other side with a gas inlet provided on the same side of the plate 54 as the outlet 152 and indicted at 58.

In use, material fed continuously through the inlet 51 by a screw conveyor 511 enters the container 53 on the lefthand side of the plate 54 and is acted upon by the agitated grinding elements 56 in the form of steel balls. The proportion of the container 53 on the lefthand side of the plate 54 is smaller than that on the righthand side and in addition the proportion of balls 56 within that portion of the container 53 relative to the material is greater than that on the righthand side and hence the material remains only for a relatively short time within the portion on the lefthand side of the plate 54. During that time it is acted upon by the agitated balls and comminuted to a degree sufficient to pass through the relatively small gap 55. In the portion on the righthand side of the plate 54, the material is acted upon by the grinding elements 57 again the form of steel balls, but of a smaller diameter than the steel balls 56.

In view of the larger volume of the righthand portion and the greater volume of space for material, the material remains for a longer period within that portion of the container 53 and is acted upon for a longer period of time by the balls 57. In addition, as there is greater space for material in the righthand portion, the balls tend to settle toward the bottom of the container 53 and hence comminuted material can be carried by a gas stream in the form of air or an inert gas passing from the inlet 58 to the outlet 152 for conveying to a downstream operation.

A filter 60 in the outlet 152 prevents the escape of balls 57 from the container 53.

In this way, the embodiment of FIG. 2 operates continuously to comminute material in two stages with the first stage providing a relatively coarse comminution sufficient to allow the material to pass into the second stage where comminution to a particle size less than 25 microns can be achieved.

As shown, the container 49 is fixedly mounted on mounting blocks 491, 492, while the oscillator 22 is movably mounted on a stand 225 to accommodate different tuning lengths of the condenser 10.

The ball fill level and ball size must be confirmed experimentally for each different material to be ground. The use of more balls of larger size on the lefthand side of the plate 54 is only exemplary due to the coarse nature of the preliminary grind for coal, but will not always be the case.

In alternative embodiments (not shown) the grinding elements 56, 57 can be replaced by rods lying along the container 53. Other grinding elements such as cylindrical pellets, prisms, triangular shapes may be used in steel or plastics.

In addition, the floor of the container 53 can be sloped at an angle of up to 15 degrees relative to the horizontal to assist the travel of the comminuted material towards the outlet 152.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. Apparatus for milling particulate material comprising a container having a peripheral wall for receiving and confining the particulate material, means for maintaining said container stationary, a planar plate mounted within the peripheral wall of the container and having a periphery substantially coextensive therewith for movement relative thereto in a direction longitudinally of the container and transversely to an original plane of the plate, the container including an inlet arranged on one side of the plate and an outlet arranged on an opposed side of the plate, a plurality of grinding elements within the container on at least one side of the plate and arranged to be confined thereby to said one side, an oscillator including an eccentric member and means for rotating the eccentric member to provide oscillatory movement at a frequency, and means for communicating oscillation from said oscillator to the plate to oscillate the plate relative to the container in said direction to agitate the grinding elements, said communicating means being arranged such that its natural frequency of vibration is tuned to the frequency of the oscillator so that the frequency of oscillation of the oscillator is substantially the same as the natural frequency of vibration of said communicating means.

2. Apparatus according to claim 1 wherein the grinding elements are balls.

3. Apparatus according to claim 1 wherein the oscillator includes an air spring.

4. Apparatus according to claim 1 wherein the inlet includes a screw conveyor.

5. Apparatus according to claim 1 including a gas inlet positioned to cooperate with the outlet for conveying the particulate material out of the container through the outlet in a gas stream.

6. Apparatus according to claim 1 wherein the periphery of the plate is spaced from the peripheral wall of the container sufficiently to allow passage of ground particulate material from one side of the plate to the other side of the plate so that the material moves from the inlet past the plate to the outlet in a continuous stream.

7. Apparatus according to claim 6 including grinding elements within the container and on both sides of the plate.

8. Apparatus according to claim 7 wherein the grinding elements on one side of the plate are of a different grade from those on the other side of the plate.

9. Apparatus for milling particulate material comprising a container having a peripheral wall for receiving and confining the particulate material, means for maintaining said container stationary, a planar plate mounted within the peripheral wall of the container and having a periphery substantially coextensive therewith for movement relative thereto in a direction longitudinally of the container and transversely to an original plane of the plate, the container including an inlet arranged on one side of the plate and an outlet arranged on an opposed side of the plate, a plurality of grinding elements within the container on at least one side of the plate and arranged to be confined thereby to said one side, an oscillator including an eccentric member and means for rotating the eccentric member to provide oscillatory movement at a frequency, and means for communicating oscillation from said oscillator to the plate to oscillate the plate relative to the container in said direction to agitate the grinding elements, said communicating means being arranged such that its natural frequency of vibration is tuned to the frequency of the oscillator so that the frequency of oscillation of the oscillator is substantially the same as the natural frequency of vibration of said communicating means, wherein the plate includes sealing means at its periphery for sealing with the peripheral wall of the container and wherein the plate is movable from a first position in which the grinding elements communicate with the inlet to a second positon wherein the grinding elements communicate with the outlet and wherein there is provided a second plate parallel to the plate and sealing means around the periphery of the second plate for sealing cooperation with the peripheral wall of the container, wherein the grinding elements are confined between the plate and the second plate and wherein the plates are movable to a position intermediate the first and second positions in which the grinding elements are separated from both the inlet and the outlet.

* * * * *